US010645492B2

(12) United States Patent
McElveen et al.

(10) Patent No.: US 10,645,492 B2
(45) Date of Patent: May 5, 2020

(54) PORTABLE COMPUTING DEVICE MICROPHONE ARRAY

(71) Applicant: Wave Sciences, LLC, Charleston, SC (US)

(72) Inventors: James Keith McElveen, Charleston, SC (US); Noah Schiffman, Charleston, SC (US); Brad Smith, Charleston, SC (US)

(73) Assignee: Wave Sciences, LLC, Charleston, SC (US)

( * ) Notice: Subject to any disclaimer, the term of this patent is extended or adjusted under 35 U.S.C. 154(b) by 0 days.

(21) Appl. No.: 16/036,410

(22) Filed: Jul. 16, 2018

(65) Prior Publication Data

US 2018/0324523 A1 Nov. 8, 2018

Related U.S. Application Data

(63) Continuation of application No. 14/703,981, filed on May 5, 2015, now Pat. No. 10,028,053.

(51) Int. Cl.
*H04R 3/00* (2006.01)
*H04R 1/40* (2006.01)

(52) U.S. Cl.
CPC ..... *H04R 3/005* (2013.01); *H04R 1/406* (2013.01); *H04R 2201/401* (2013.01); *H04R 2499/15* (2013.01)

(58) Field of Classification Search
CPC .. H04R 1/08; H04R 1/2892; H04R 2201/401; H04R 3/005; H04R 17/02; H04R 1/086; H04R 1/406; H04R 25/407; H04R 2430/20; H04R 31/006; H04R 2201/02; H04S 2400/15
USPC ..... 455/575.1, 575.2, 575.3, 575.4, 575.6; 700/94; 381/122, 337, 339, 345, 350, 381/351, 355, 3, 357, 359, 358, 360, 361, 381/365, 364, 366, 373, 374, 375, 381/111–115
See application file for complete search history.

(56) References Cited

U.S. PATENT DOCUMENTS 5,748,757 A * 5/1998 Kubli ..... H04R 1/406 381/160
8,213,634 B1 * 7/2012 Daniel ..... H04R 3/005 381/122

* cited by examiner

*Primary Examiner* — Leshui Zhang
(74) *Attorney, Agent, or Firm* — Gregory Finch; Finch Paolino, LLC

(57) ABSTRACT

A directional microphone array which can be integrated into a case for a portable computing device. A microphone array board connects to a surface of a laptop computer, tablet computer or smart phone, which can be steered in the direction of a target source. An audio processing module (APM) is operably engaged with the array board to receive a first staged beamformed audio input from the array board, and process a second beamformed stage audio output.

15 Claims, 4 Drawing Sheets

PORTABLE COMPUTING DEVICE MICROPHONE ARRAY

CROSS-REFERENCE TO RELATED APPLICATIONS

This application is a continuation of U.S. application Ser. No. 14/703,981, filed May 5, 2015, hereby incorporated by reference in its entirety herein.

FIELD

The present disclosure relates to the field of directional audio systems; in particular, a microphone array apparatus that is removably attached to a mobile electronic device, such as a laptop computer.

SUMMARY

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

An object of the present invention is a microphone array apparatus comprising an array surface that passes acoustic signals therethrough having an attachment means at a first edge and a second edge configured to connect to a portion of an electronic device such that the array surface can be removably disposed on a substantially planar surface of the electronic device; and, a plurality of microphones disposed on a surface of the fabric array surface.

Another object of the present invention is a microphone array apparatus comprising a housing configured to be selectively coupled to a substantially planar surface of an electronic device such that a perimeter of the housing is configured to partially encompass the substantially planar surface of the electronic device, the housing having an interior surface and an exterior surface and at least one aperture configured to pass acoustic signals therethrough; and, a plurality of microphones being coupled to a surface of the housing such that the plurality of microphones are operable to receive acoustic signals passed through the at least one aperture.

Yet another object of the present invention is a microphone array apparatus comprising a coupling mechanism configured to removably attach to a surface of an electronic device; an articulating mechanism coupled to the coupling mechanism; an array surface coupled to the articulating mechanism such that the array surface may be selectively positioned in the direction of a target audio source; and, a plurality of microphones disposed on the array surface.

The foregoing has outlined rather broadly the more pertinent and important features of the present invention so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent structures do not depart from the spirit and scope of the invention as set forth in the appended claims.

BRIEF DESCRIPTION OF DRAWINGS

The above and other objects, features and advantages of the present disclosure will be more apparent from the following detailed description taken in conjunction with the accompanying drawings, in which.

DETAILED DESCRIPTION

Figure 2:
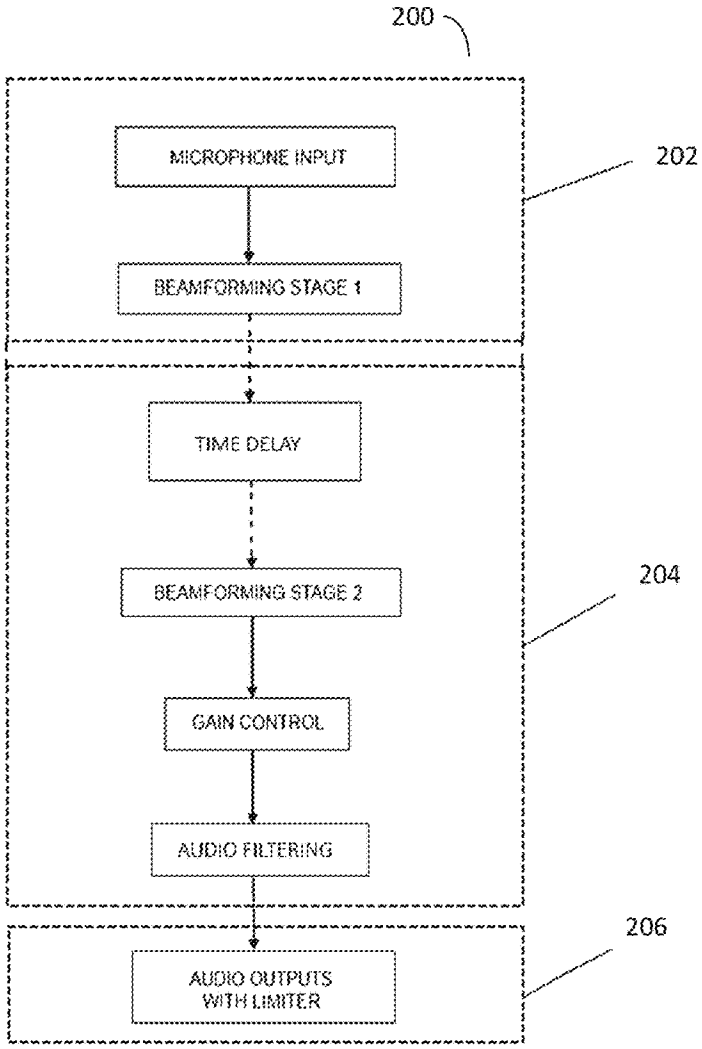
FIG. 2 is a system diagram illustrating an embodiment of the present disclosure.

Exemplary embodiments are described herein to provide a detailed description of the present disclosure. Variations of these embodiments will be apparent to those of skill in the art. Moreover, certain terminology is used in the following description for convenience only and is not limiting. For example, the words "right," "left," "top," "bottom," "upper," "lower," "inner" and "outer" designate directions in the drawings to which reference is made. The word "a" is defined to mean "at least one." The terminology includes the words above specifically mentioned, derivatives thereof, and words of similar import.

Embodiments of the present disclosure provide for a directional microphone array integrated into a case for a portable computing device; and a flexible microphone array that can be removably attached to a portable computing device. Embodiments of the current disclosure enable a user to attach an array of microphones to an electronic device such as laptop computers, tablet computers, digital video cameras, computer monitors, and smart phones. Audio input captured by the microphone array may be rendered as an audio output for applications such as helping hearing impaired users improve hearing in classroom setting;

improving audio recording applications in crowded environments; and, enabling portable computing devices such as smart phones and tablet computers to capture high definition audio and render it live or to digital audio or video files.

Figure 1:
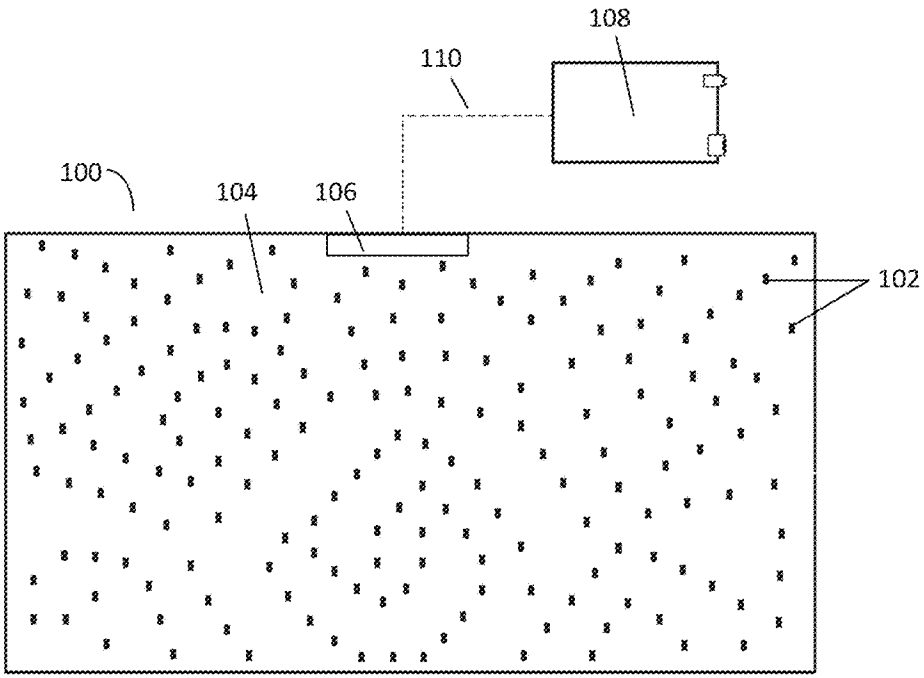
FIG. 1 is a perspective view of a microphone array and audio processing module according to an embodiment of the present disclosure.

Referring now to the invention in more detail, FIG. 1 illustrates a microphone array and audio processing module according to an embodiment of the present disclosure. The construction details of the invention as shown in FIG. 1 are, in a preferred embodiment, a microphone array 100 comprised of an array surface 104 with surface mounted or embedded microphones 102 and output circuitry 106. In an embodiment, array surface 104 is constructed of a printed circuit board with surface mounted microphones 102. Array surface 104 may be constructed of other substrates with printed circuits, conductive wires, or other means to connect the microphones 102 using wired or wireless techniques. Microphones 102 are typically mounted on a single side of array surface 104. In an embodiment, microphones 102 may be arranged in a nested circle configuration with fractal-based spacing between the circles and microphones.

Sound captured by microphones 102 on the array surface 104 may be sent to an audio processing module (APM) 108 through an electrical bus 110. APM 108 is optional to the function of microphone array 100, and serves to perform audio processing functions such as time delay, second stage beamforming, gain or volume control and audio filtering. APM 108 may be omitted from embodiments where these audio processing functions are not required by the commercial application in which microphone array 100 is applied. APM 108 may be integral to or mounted on array surface 104, or may be executed on an external processor of an electronic device; such as a laptop computer, tablet computer or smart phone. In an embodiment, APM 108 includes a USB connection that provides DC power from a remote battery source or other electrical power source and may also provide an audio, video, programming, and or control interface to a laptop or other computing device. APM 108 may include an output connection interface for a listening headset and an additional audio output.

Other variations on this construction technique include, but are not limited to, microphones connected using wired, wireless or optical interconnects, arranged in the same or similar geometric pattern and mounted on or in a host device; the main array board made of other materials, such as hard PCB or fabric with conductive wires or other substances to electrically connect the microphones to the electronics module, power, and ground; other arrangements of microphones, such as equal, random, Golden Spiral, and Fibonacci spacing; and embodiment variations that include vibration or sound absorbing layers of neoprene rubber or similar materials on top and/or bottom.

Other variations on this construction technique are anticipated, including but not limited to embedding APM 108 inside of other housings or devices, such as using analog or digital electronics, including DSPs (digital signal processors), ASICs (application specific integrated circuits), FPGA (field programmable gate arrays) and similar technologies, to implement generally the same signal processing using digital devices as is being accomplished using analog and/or hybrid devices. Other variations on this construction technique further include the use of wireless links to replace one or more cables; the use of Bluetooth for outputting audio and/or module control; use of a USB interface for outputting audio and/or module control; the integration of the electronics contained in the audio processing module onto array board 104.

Referring now to FIG. 2, a system diagram illustrating an embodiment of the present disclosure is shown. According to an embodiment, system 200 captures sound from a target source, processes it to reduce sounds arriving from directions other than the acoustic corollary of field-of-view, and outputs the directional sounds for a user. In more detail, still referring to FIG. 2, array apparatus 202 is selectively coupled to an electronic device. A plurality of microphones on array apparatus 202 capture acoustic signals from a target source. Acoustic signals are beamformed in single or multiple groups in a first stage of beamforming directly on an electrical bus into single or multiple channels. In an embodiment, audio signals from the first stage of beamforming may be delivered to an audio processing module 204. Audio processing module 204 may be integral or external to microphone array 202. In an embodiment, a pre-beamformed channel or channels may have engineered time delay(s) applied and then the channels are processed again in a second stage of beamforming executing on audio processing module 204 to accomplish or help to accomplish steering of the pick-up pattern (beam), signal cancellation, or signal separation. Linear or automatic gain control (which may also include dynamic range control and similar amplitude filtering) and audio frequency filtering may then be applied selectively prior to the directional audio being produced at an audio output 206. Audio output device 206 may include line, microphone, headphone or wireless audio output, or may be incorporated into analog or digital audio and or video formats as an interface to an electronic device operably engaged with microphone array 202. Electronic devices can include laptop computers, tablet computers, digital photo and video cameras, computer monitors, smart phones, or computer or other telecommunications networks.

Other variations on this system include adding successive stages of beamforming; alternative orders of filtering and gain control; use of reference channel signals to remove directional or ambient noises; use of time or phase delay elements to steer the directivity pattern; the use of digital microphones and digital signal processing to accomplish the same general technique; and the use of one or more signal separation algorithms instead of or in addition to one or more beamforming stages.

Figure 3B:
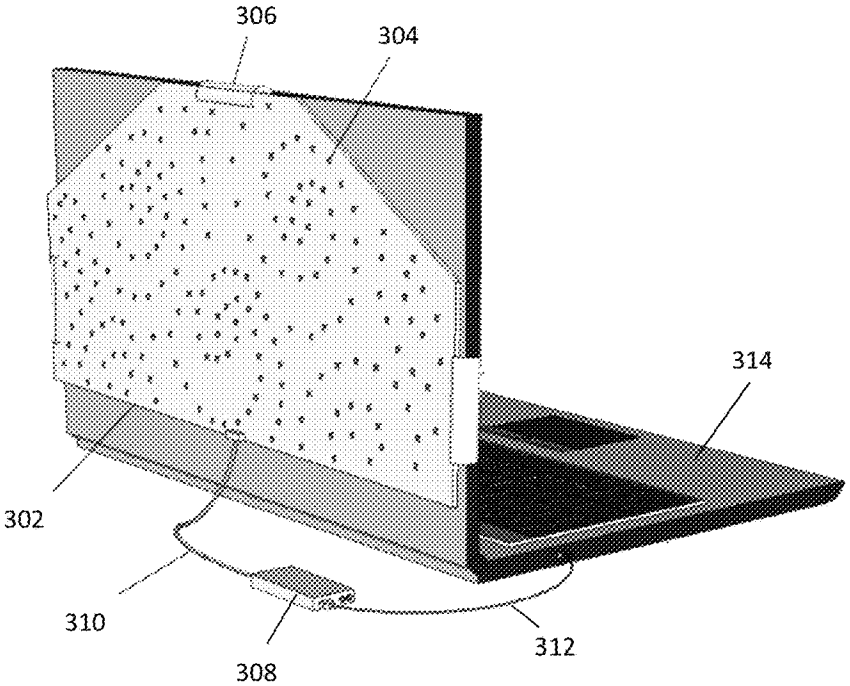
FIG. 3*b* is a perspective view of a microphone array apparatus attached to a laptop computer according to an embodiment of the present disclosure.
Figure 3A:
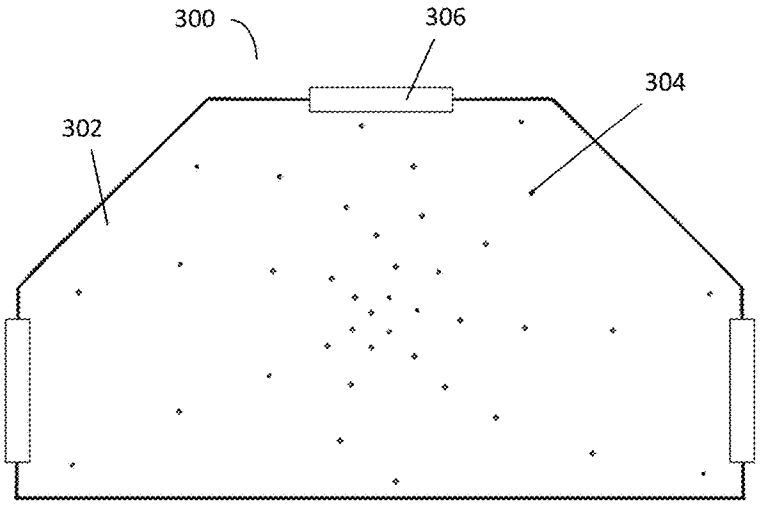
FIG. 3*a* is a perspective view of a microphone array apparatus according to an embodiment of the present disclosure.

FIG. 3*a* is a perspective view of a microphone array apparatus according to an embodiment of the present disclosure. According to an embodiment, a microphone array apparatus 300 is comprised of an array surface 302 constructed from a substantially stretchable or bendable fabric capable of passing acoustic signals therethrough; for example, neoprene, spandex blend, and the like. Array surface 302 may be folded or rolled for storage, and unfolded or unrolled and selectively coupled to a portable computing device when in use.

Array surface 302 has a plurality of individually wired microphones 304 woven or mounted onto array surface 302. Array apparatus 300 may have one or more retention clips 306 capable of being selectively attached to a surface of an electronic device, such as a laptop computer. Retention clips 306 may be substituted by any attachment means capable of selectively coupling array surface 302 to a surface of an electronic device; for example, adhesive strips, hook-and-loop fasteners, magnets, and/or mechanical fittings, clamps and the like.

FIG. 3*b* is a perspective view of a microphone array apparatus attached to a laptop computer according to an embodiment of the present disclosure. According to an embodiment, array surface 302 is coupled to laptop 314 by selectively coupling retention clips 306 to the edges of an exterior surface of a display of laptop 314. A first stage of beamformed audio from microphones 304 may be communicated to an audio processing module 308 by an electrical bus 310. Audio processing module 308 may communicate a second stage of beamformed audio to laptop 314 through an output cable 312.

Figures 4A, 4B:
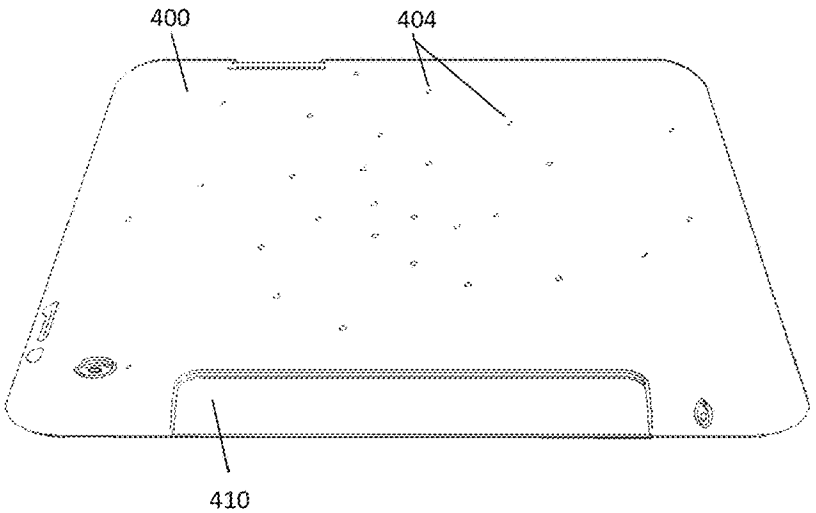
FIG. 4*a* is a perspective view of a microphone array apparatus according to an embodiment of the present disclosure.
FIG. 4*b* is a perspective view of a microphone array apparatus attached to a tablet computer according to an embodiment of the present disclosure.

FIG. 4*a* is a perspective view of a microphone array apparatus according to an embodiment of the present disclosure. According to an embodiment, a housing 400 is configured to be selectively coupled to an electronic device 408 by at least partially encompassing a portion of the electronic device. In FIGS. 4*a* and 4*b*, housing 400 is configured to be selectively coupled to a tablet computer 410. Housing 400 can be configured to be selectively coupled to laptop computers, tablet computers, digital photo and video cameras, computer monitors, smart phones, and the like. Housing 400 has an interior surface (as illustrated in FIG. 4*a*) and an exterior surface (as illustrated in FIG. 4*b*). A plurality of microphones 402 may be coupled to an interior surface of housing 400 comprising an array surface 408. Microphones 402 may be individually wired and coupled directly to the interior surface of housing 400 to comprise array surface 408; or, microphones 402 may be surface mounted to a flexible printed circuit board coupled to interior surface of housing 400 comprising array surface 408.

FIG. 4*b* is a perspective view of a microphone array apparatus attached to a tablet computer according to an embodiment of the present disclosure. According to an embodiment, housing 400 has a plurality on apertures 404 configured to pass acoustic signals to the plurality of microphones 402. Microphones 402 may be substantially aligned with the plurality of apertures 404 such that a user may steer housing 400 to capture acoustic signals from a target source. Acoustic signals captured by microphones 402 may be beamformed in a first stage of beamforming directly on an electrical bus into one or more channels and may be communicated wirelessly or via an output connector to tablet computer 410 or to an output device such as headphones. In an embodiment, audio signals from the first stage of beamforming may be delivered to an audio processing module 406. Audio processing module 406 may be mounted on array surface 408 as shown in FIG. 4*a*; or may be internal to tablet computer in 410. Audio processing module 406 serves to perform audio processing functions such as time delay, second stage beamforming, gain control and audio filtering; and may be omitted in commercial applications where such processing functions are unnecessary or accomplished by external processors.

Figure 5B:
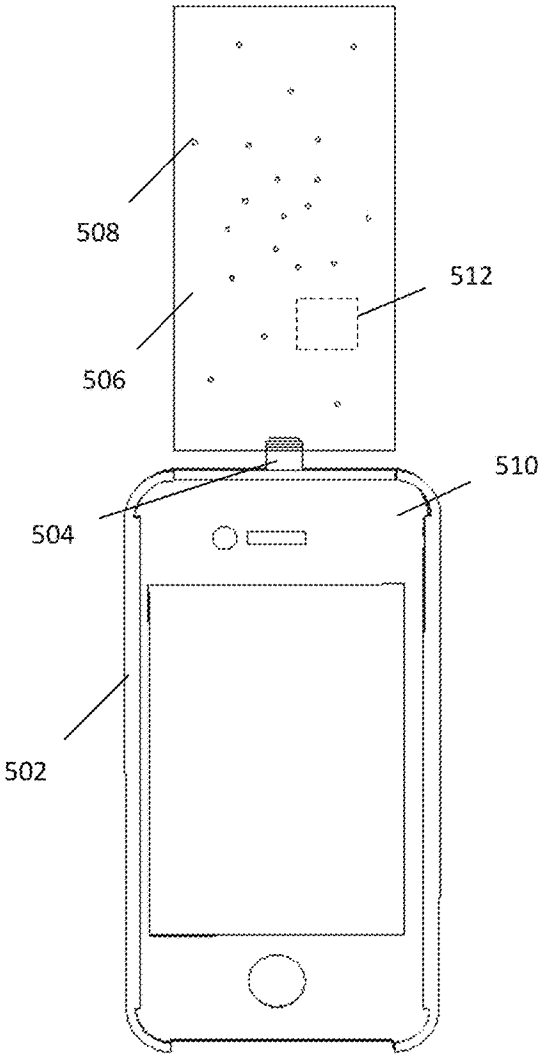
FIG. 5*a* is a perspective view of a microphone array apparatus according to an embodiment of the present disclosure; and, FIG. 5*b* is a perspective view of a microphone array apparatus attached to a smart phone according to an embodiment of the present disclosure.
Figure 5A:
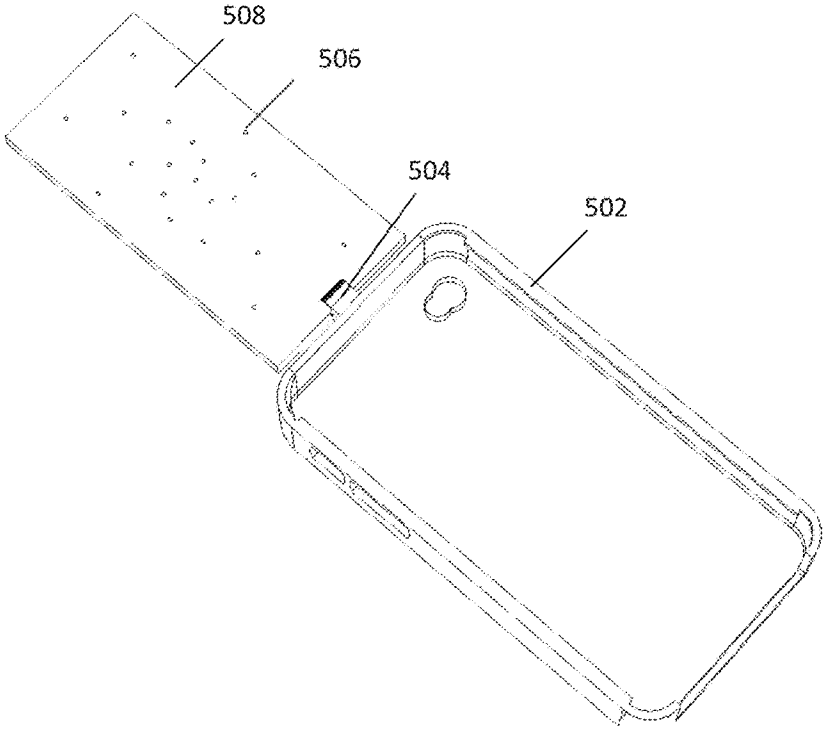

FIG. 5*a* is a perspective view of a microphone array apparatus according to an embodiment of the present disclosure. According to an embodiment, a housing 502 is configured to be selectively coupled to an electronic device 510 by at least partially encompassing a portion of the electronic device. In FIGS. 5*a* and 5*b*, housing 502 is configured to be selectively coupled to a smart phone 410. Housing 502 can be configured to be selectively coupled to laptop computers, tablet computers, digital video cameras, computer monitors, smart phones, and the like. Housing 502 has an articulating mechanism 504 coupled to an upper surface. Articulating mechanism 504 is configured to manipulate the position of an array surface 506 in a range of about 180 degrees vertically and about 180 degrees horizontally, such that array surface 506 may be selectively positioned (steered) in the direction of a target audio source. A plurality of microphones 508 may be coupled to one or both sides of array surface 506. Microphones 508 may be individually wired and coupled directly to array surface 506; or, microphones 402 may be surface mounted to a printed circuit board coupled to array surface 506.

FIG. 5*b* is a perspective view of a microphone array apparatus attached to a smart phone according to an embodiment of the present disclosure. According to an embodiment, a user may steer array surface 506 in a direction of a target audio source such that microphones 508 mounted on array surface 506 can capture acoustic signals from the target audio source.

Acoustic signals captured by microphones 508 may be beamformed in a first stage of beamforming directly on an electrical bus into one or more channels and may be communicated wirelessly or via an output connector to smart phone 510 or to an output device such as headphones. In an embodiment, audio signals from the first stage of beamforming may be delivered to an audio processing module 512. Audio processing module 512 may be mounted on array surface 506 as shown in FIG. 5*b*; or may be internal to smart phone in 510. Audio processing module 512 serves to perform audio processing functions such as time delay, second stage beamforming, gain control and audio filtering; and may be omitted in commercial applications where such processing functions are unnecessary or accomplished by external processors.

The present disclosure includes that contained in the appended claims as well as that of the foregoing description. Although this invention has been described in its exemplary forms with a certain degree of particularity, it is understood that the present disclosure of has been made only by way of example and numerous changes in the details of construction and combination and arrangement of parts may be employed without departing from the spirit and scope of the invention.

What is claimed is:

1. A microphone array apparatus comprising:
   - a housing configured to be selectively coupled to a substantially planar surface of an electronic device such that a perimeter of the housing is configured to at least partially encompass the substantially planar surface of the electronic device, the housing comprising:
     - an interior surface facing the substantially planar surface of the electronic device and comprising an array surface;
     - a plurality of microphones individually coupled directly to the interior surface comprising the array surface such that the plurality of microphones is arranged in the array surface in a nested circle configuration with fractal-based spacing between the circles and the microphones; and
     - an exterior surface comprising a plurality of apertures, the plurality of apertures being configured to pass acoustic signals from an exterior of the housing to the plurality of microphones,
       - wherein the plurality of microphones is operable to capture the acoustic signals passed through the plurality of apertures, and
       - wherein, in a first beamforming stage, the acoustic signals captured by the plurality of microphones are beamformed into one or more channels by an electrical bus.

2. The microphone array apparatus of claim 1 further comprising an audio processing module mounted on the array surface comprised on the interior surface of the housing, the audio processing module being operable to receive the acoustic signals captured by the plurality of microphones and beamformed during the first beamforming stage and to produce an audio output during a second beamforming stage.

3. The microphone array apparatus of claim 2 further comprising an electrical bus operable to communicate, in the first beamforming stage, the acoustic signals captured by the plurality of microphones to the audio processing module.

4. The microphone array apparatus of claim 2 wherein the audio processing module is further operable to perform time delay, gain control and audio filtering of the audio output.

5. The microphone array apparatus of claim 1 wherein the plurality of microphones is arranged in the array surface in a substantially fractal-based configuration.

6. The microphone array apparatus of claim 1 wherein the electronic device is selected from the group consisting of laptop computers, tablet computers, digital video cameras, computer monitors, and smart phones.

7. The microphone array apparatus of claim 1 wherein the plurality of microphones is substantially aligned with the plurality of apertures so as to enable capturing of acoustic signals by the plurality of microphones from a target source exterior to the housing by a steering of the housing.

8. A microphone array apparatus comprising:

a housing configured to be selectively coupled to a substantially planar surface of an electronic device such that a perimeter of the housing is configured to at least partially encompass the substantially planar surface of the electronic device, the housing comprising:

an interior surface facing the substantially planar surface of the electronic device;

a flexible printed circuit board coupled to the interior surface and comprising an array surface;

a plurality of microphones surface mounted to the flexible printed circuit board comprising the array surface; and an exterior surface comprising a plurality of apertures, the plurality of apertures being configured to pass acoustic signals from an exterior of the housing to the plurality of microphones, wherein the plurality of microphones is operable to capture the acoustic signals passed through the plurality of apertures, and wherein, in a first beamforming stage, the acoustic signals captured by the plurality of microphones are beamformed by an electrical bus.

9. The microphone array apparatus of claim 8 wherein the plurality of microphones is substantially aligned with the plurality of apertures so as to enable capturing of acoustic signals by the plurality of microphones from a target source exterior to the housing by a steering of the housing.

10. The microphone array apparatus of claim 8 wherein the plurality of microphones is surface mounted to the flexible printed circuit board comprising the array surface in a substantially fractal-based configuration.

11. The microphone array apparatus of claim 8 wherein the electronic device is selected from the group consisting of laptop computers, tablet computers, digital video cameras, computer monitors, and smart phones.

12. The microphone array apparatus of claim 8 further comprising an electrical bus operable to beamform the acoustic signals captured by the plurality of microphones into one or more channels wirelessly or via an output connector during the first beamforming stage.

13. The microphone array apparatus of claim 8 further comprising an audio processing module mounted on the array surface comprised on the flexible printed circuit board on the interior surface of the housing, the audio processing module being operable to receive the acoustic signals captured by the plurality of microphones and beamformed during the first beamforming stage and to produce an audio output during a second beamforming stage.

14. The microphone array apparatus of claim 13, further comprising an electrical bus operable to communicate, in the first beamforming stage, the acoustic signals captured by the plurality of microphones to the audio processing module.

15. The microphone array apparatus of claim 13 wherein the audio processing module is further operable to perform time delay, gain control and audio filtering of the audio output.

* * * * *